US005540499A

United States Patent [19]

Seeger

[11] Patent Number: 5,540,499

[45] Date of Patent: Jul. 30, 1996

[54] DEVICE FOR DISPERSING, SUSPENDING OR EMULSIFYING GASES, LIQUIDS AND/OR FLOWABLE SOLID SUBSTANCES, MORE PARTICULARLY FOR WETTING AND DISPERSING POWDERS IN LIQUIDS

[75] Inventor: Hanspeter Seeger, Dottingen, Germany

[73] Assignee: Ystral GmbH maschinenbau + prozesstechnik, Ballrechten-Dottingen, Germany

[21] Appl. No.: 157,150

[22] PCT Filed: Jun. 9, 1992

[86] PCT No.: PCT/EP92/01284

§ 371 Date: May 9, 1994

§ 102(e) Date: May 9, 1994

[87] PCT Pub. No.: WO92/21436

PCT Pub. Date: Dec. 10, 1992

[30] Foreign Application Priority Data

Jun. 7, 1991 [DE] Germany ..... 41 18 870.5

[51] Int. Cl.[6] ..... B01F 7/00

[52] U.S. Cl. ..... 366/181.4; 366/304

[58] Field of Search ..... 366/168, 171, 366/172, 176, 178, 181.4, 264, 304, 306, 307

[56] References Cited

U.S. PATENT DOCUMENTS

| | | | |
|---|---|---|---|
| 2,071,393 | 2/1937 | Doherty . | |
| 2,619,330 | 11/1952 | Willems . | |
| 3,183,099 | 5/1965 | Schultz | 366/305 |
| 3,194,540 | 7/1965 | Hager . | |
| 3,195,867 | 7/1965 | Mould, Jr. | 366/305 |
| 3,256,181 | 6/1966 | Zingg et al. . | |
| 3,393,802 | 7/1968 | Logue et al. . | |
| 3,606,270 | 9/1971 | Zimmerly . | |
| 3,934,857 | 1/1976 | Hege . | |
| 4,136,971 | 1/1979 | Varlamov | 366/305 |
| 4,687,339 | 8/1987 | Seeger | 366/305 |
| 4,915,509 | 4/1990 | Sauer | 366/171 |
| 5,085,513 | 2/1992 | Ivarson | 366/196 |

FOREIGN PATENT DOCUMENTS

| | | | |
|---|---|---|---|
| 2004143 | 8/1971 | Germany . | |
| 7514424 | 1/1976 | Germany . | |
| 2702183 | 7/1978 | Germany . | |
| 3002429 | 7/1981 | Germany . | |
| 3413675 | 11/1985 | Germany . | |
| 3517655 | 11/1986 | Germany . | |
| 1604446 | 11/1990 | U.S.S.R. | 366/305 |
| 1632481 | 3/1991 | U.S.S.R. | 366/305 |
| 1639733 | 4/1991 | U.S.S.R. | 366/305 |
| 856273 | 12/1960 | United Kingdom | 366/305 |
| 1258898 | 12/1971 | United Kingdom | 366/305 |

OTHER PUBLICATIONS

Verfahrenstechnik 1992, No. 3.

Wittnerberger, *Chemische Betriebstecnik,* Springer–Verlag, S. 243/244.

*Ullmanns Encyklopädie der technischen Chemie,* 4. Auflage, Band 2, (Verfahrenstechnik I) Verlag Chemie.

*Primary Examiner*—David Scherbel

*Assistant Examiner*—Randall E. Chin

*Attorney, Agent, or Firm*—Wood, Phillips, VanSanten, Clark & Mortimer

[57] ABSTRACT

A device for dispersing, emulsifying or suspending gases, liquids or granular substances, more particularly for wetting and dispersing powders in liquids, includes a disc-shaped rotor (8) in a dispersing chamber (7), with two substance inlets (72, 76) and one product outlet (11). Each substance inlet (72, 76) preferably has axial duct portions (75, 83, respectively) disposed on each side of the rotor (8). The two substance streams are arranged to bring together the substances in the outer edge region of the rotor disc (67). The product outlet (11) is at an outer edge of the dispersing chamber (7).

21 Claims, 3 Drawing Sheets

DEVICE FOR DISPERSING, SUSPENDING OR EMULSIFYING GASES, LIQUIDS AND/OR FLOWABLE SOLID SUBSTANCES, MORE PARTICULARLY FOR WETTING AND DISPERSING POWDERS IN LIQUIDS

The invention relates to a device for dispersing, emulsifying or suspending gases, liquids or granular substances, more particularly for wetting and dispersing powders in liquids. The operation or efficiency of a device of this kind usually depends on its ability to handle substances which are difficult to process. If the device can process these substances, it is usually also suitable for treatment of easily-processed substances. Powder is considered a substance difficult to process. Clogging may occur when powder is conveyed through the device, since powder tends to form bridges which are the cause of clogging in many cases. The risk of clogging when processing a powder is particularly great when the powder is wetted with a liquid. This can be explained in that, on the first wetting contact, the powder or parts of the powder are only slightly moistened, whereafter the tendency to coagulate, form bridges and stick to walls of the device is particularly great.

Devices of the above-mentioned kind have already been developed in a number of forms, such as agitators, immersed during operation in a container holding the substance or substances to be processed, or devices comprising a closed working chamber through which the substance or substances for processing are conveyed during operation.

DE-OS 27 02 183 discloses a device in the form of an agitator, the substance for processing being sucked in parallel to the axis of rotation of the rotor, and radially ejected by a dispersing device in the form of shearing rims disposed in the flow direction downstream of the bladed rotor. In this known device, there are no guide devices which enable the supply of different substances separately to the bladed rotor.

German Offenlegungsschrift 30 02 429 describes a device for dispersing gas, powder and fluids having an agitator or jet blender, in which two separate supply pipes for the substances to be processed extend coaxially into the bladed-rotor region, through a jacket surrounding the rotor shaft, so that the substances can be fed into the bladed-rotor region separately from the product material found within the revolution of the agitator.

U.S. Pat. No. 3,194,540 describes a device for homogenizing a substance and comprising a number of rotating shearing rims disposed coaxially with one another in a casing. The substance for processing is axially supplied relative to the rotor axis, radially expelled through the shearing rims, and then discharged from the casing.

A device comprising two inlets on one side of the rotor has already been proposed for dispersing or emulsifying at least two media or substances which tend to change their state on mutual contact. The substances are guided radially outwardly through a dispersion device comprising two shearing rims rotating relative to one another. The media flow in separate ducts, the ducts alternating in the peripheral direction, until the media enters the internal shearing rim.

A common shortcoming of the known devices is that owning to the complicated piping for supplying the substances, they are not suitable for processing powders or granular substances because of disturbances to the through-flow of material, clogging and production failure. The dispersion process is also unsatisfactory.

A device of the above-mentioned kind is described in German patent publication C-501 546. In this device for generating foam for fire-extinguishing purposes, substance inlets, for supplying water and a dry chemical, are disposed on the two sides of a disc-shaped rotor in the form of an impeller. The inlets are initially directed axially towards one another and then radially directed. An annular duct is disposed at the rotor periphery. During operation of the device, the water and dry chemical are pressed by the centrifugal force into the annular duct.

The object of the invention is to improve the mechanical action on the substances and consequently improve the comminution, fine division, dispersion, emulsification and/or suspension.

This object is achieved by a device including a disc-shaped rotor in a wetting/mixing chamber, with two substance supply ducts and one product outlet. One substance inlet is preferably disposed on each side of the rotor. The two substance streams are brought together in the outer edge of the rotor disc, and a product outlet is at an outer edge of the wetting/mixing chamber.

The device according to the invention not only has a simple, small construction, but also provides a simple means of supplying two substances (which are also referred to herein as media) separately from one another, right into the dispersion/mixing region. The advantage of this is that the bringing together of the substances, more particularly the wetting of the powder or granular substances, takes place only in the region in which the substances are mechanically acted upon and mixed with one another, and if applicable comminuted and finely divided. Consequently the substances cannot react until they reach the dispersion region, with the result being that the substances are already partly distributed in one another before they undergo a change of state through mutual contact. The substances can thus be distributed in one another before the process is significantly limited and hindered by the change in state. In the case of substances that are difficult to process, such as powders and granules, state changes (such as those caused by wetting) that result in a tendency for clogging cause no harm, since the powders or granules are already in the region in which it is mechanically acted upon, and consequently there can be no clogging or through-flow disturbances during supplying.

The configuration according to the invention also improves the mechanical action on the substances and thus improves comminution, fine division, dispersion, emulsification and/or suspension, and has the special advantage that a drawing-in effect or suction into the dispersion region is exerted on two substances supplied on two sides of the rotor. This is due to the centrifugal force to which the substances are subjected as a result of friction with the rotating rotor.

The device according to the invention can be realized in the form of a continuously operating machine, and is particularly suitable for use and dispersion of powders in liquids.

The powders can be any free-flowing materials, such as starch, bentonite, Aerosil, Carbopol, pectin, kaolin, cellulose, etc.

The device automatically sucks in the powder from e.g., sacks, Big-Bags or silos.

At low concentrations of powder in the liquid, powder substances are introduced or processed in a single continuous flow. At high concentrations, operation is cyclic until the final concentration is reached.

The following special advantages of the method according to the invention are emphasized.

Automatic suction of powder substances is an important benefit of the design. Trouble-free operation is achieved, even in the case of powders such as cellulose or bentonite which experience a simultaneous increase in viscosity upon wetting of the powder with the liquid. High sucking-in power of the substances, including the powder, and complete colloidal wetting are achieved by the design. Stable construction of the device provides for industrial use under arduous conditions, and a long service life.

The configurations of the device as described herein improves the mechanical action on the substances and thus improves comminution, fine division, dispersion, emulsification and/or suspension.

The centrifugal force is particularly great near radial holes in a perforated sleeve, because the substances in the holes rotate at higher speed. Particularly intensive mechanical action on these substances can be obtained by means of the features of the device.

The rotor preferably has a blade or blades formed by a flat web disposed substantially radially and axially which result in an outlet opening favorable to the flow, which also has a large cross-sectional area, where the rotor exerts additional mechanical action on the product and simultaneously effects ejection of the product.

Further, the invention also relates to a simple and very effective spatial form of the chamber (also denoted by the general term "wetting chamber") in which the substances are mechanically acted upon.

Moreover, the invention also comprehends advantageous configurations for substance supply, more particularly for powder supply, so that a trouble-free supply, more particularly an automatic supply of powder from containers, is possible.

In the device according to the invention, the substances adjacent to the rotor are subjected to radial acceleration, enabling the device to operate without trouble irrespective of its disposition in space. The device according to the invention, therefore, can be operated not only when upright with the rotor axis vertical, but also when horizontal with the rotor axis horizontal.

In short, the device according to the invention is distinguished in that, by means of one rotor, two streams of substances are radially accelerated and initially supplied separately by centrifugal force. A vacuum (under pressure) being produced in the neighborhood of each substance stream at the center of the rotor, due to the radial acceleration of the substances. As a result of this vacuum, the substances, particularly powder, can be drawn in without trouble and irrespective of the disposition or orientation of the device. The substances can then be finely distributed and if applicable wetted and dispersed.

The invention and additional advantages resulting therefrom will now be explained in detail with reference to preferred embodiments and drawings, in which.

Figure 2:
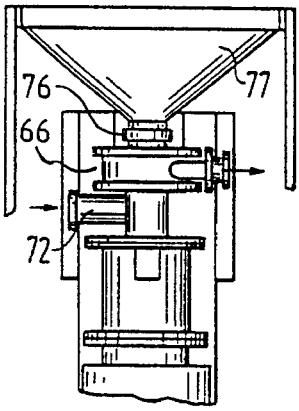
FIG. 2 is a side view of the device from the right.
Figure 1:
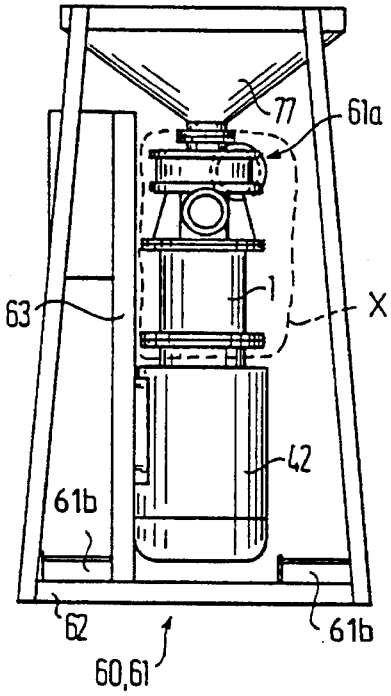
FIG. 1 is a front view of the device according to the invention, when vertical.
Figure 3:
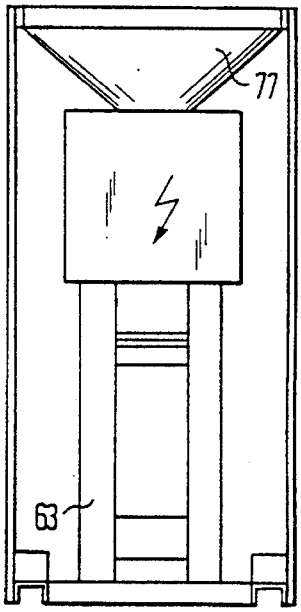
FIG. 3 is a side view of the device from the left.
Figure 4:
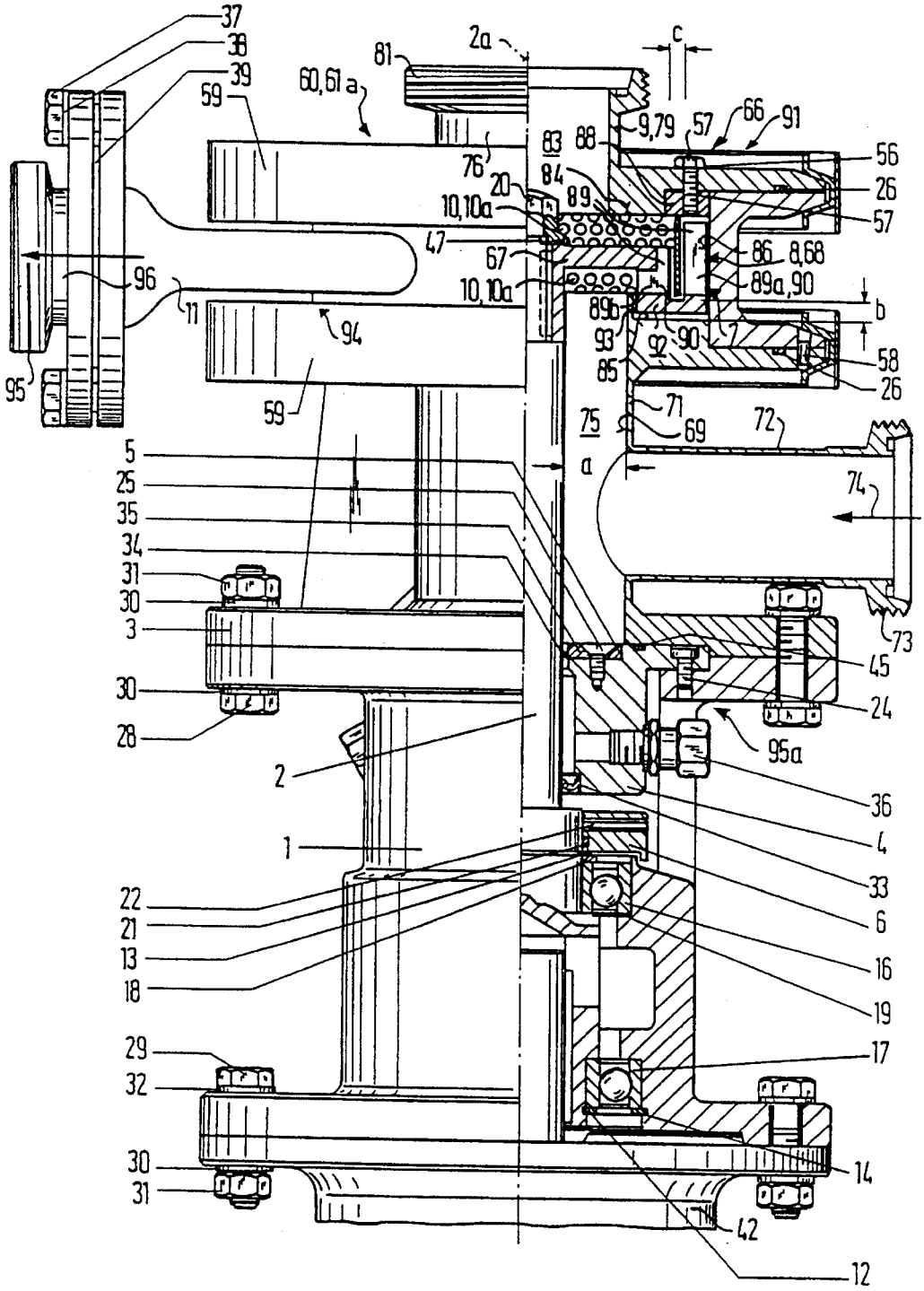
FIG. 4 is a larger-scale view, partly in section, of the detail of the device marked X in FIG. 1.

As FIGS. 1 to 3 show, the device 60 comprises a stand 61 comprising a horizontal bearing frame 62 at the bottom, from which a vertical clamping frame or clamping rails 63 extend upright, to which is attached a dispersion, emulsification and/or suspension unit 61*a* disposed upright and in central position relative to the stand 61. The unit 61*a* comprises an electric motor 42 shown as having a vertical axis of rotation and the casing of which is surmounted by an intermediate casing or bearing flange 1 which in turn is surmounted by a rotor casing 66, flanged and screwed one on the other. Referring to FIG. 4, the motor 42 has a shaft that is upwardly prolonged by a shaft 2 which extends to the upper region of the rotor casing 66. A rotor 8 secured to the top end of the shaft 2 comprises a radial rotor disc or hub 67 and a rotor rim 68 secured to the periphery thereof. The rotor rim 68 is wider than the rotor disc 67, so that it projects axially to both sides of the rotor disc 67.

The shaft 2 is coaxially disposed in the rotor casing 66 with an annular space having a width "a" of several centimeters being provided between the shaft 2 and the inner wall 69 of the rotor casing 66. At a distance from the rotor 8 in the direction of the motor 42, a radial connecting piece 72 is mounted in the rotor-casing wall 71. The connecting piece 72 has at its free end a coupling part, more particularly a screw coupling part 73, to which a diagrammatically-indicated supply pipe 74 for a first medium to be treated, more particularly liquid, can be connected. The connecting piece 72 and the annular space "a" form a supply duct 75 for the medium, extending in the flow direction up to the front of the rotor disc 67.

A coaxially upwardly projecting piping portion 76 is disposed on the top surface of the rotor casing 66 and is connected at the top to a funnel 77 (shown in FIGS. 1 to 3) for a second medium/substance, more particularly powder. The piping portion 76 thus constitutes a second supply pipe 79 and a connecting piece can be connected to additional parts of the supply pipe 79 via a coupling part 81, more particularly a threaded coupling 81*a*. If applicable, the additional supply pipe 79 is a hose 79*a* (shown in FIG. 5) for sucking the second medium out of storage containers 79*b*, e.g., sacks, Big-Bags or silos with a manually operable shut-off valve 82 disposed in the second supply pipe 79, releasably connected to the hose 79*a*, likewise more particularly connected by a screw coupling 80. The piping portion 76 constitutes a second supply duct 83, which extends in the opposite direction of the first supply duct 75, to the rotor disc 67. The shaft 2 substantially terminates at the top of the rotor disc 67 at a cap nut 20 that projects slightly upwards so that the second supply duct 83 in conjunction with the associated inner wall of the rotor casing 66 also ends in a ring.

A mixing chamber 7 is provided in the rotor casing 66 in the plane of rotation of the rotor 8 and is formed by an interiorly located peripheral groove of substantially rectangular cross-section. The outer edge of the rotor 8 extends into this annular mixing chamber 7. The chamber 7 is bounded axially by radial flat wall surfaces 84, 85 of the inner peripheral groove, and radially by a cylindrical inner surface 86 of the rotor casing 66. A stator, preferably a sieve or screen insert in the form of a hollow cylindrical perforated ring or perforated sleeve 10 (preferably made of metal sheet), is disposed in the radial central region of the mixing chamber 7, i.e., the region between the outer peripheral edge of the rotor 8 and the inner surface 86 where mixing occurs, and extends from the one wall surface 84 (the top surface in the present case) and ends at a distance "b" from the bottom wall surface 85. The top edge of the perforated sleeve 10 is secured to a securing ring 88, which is recessed into the wall surface 84 and is externally secured by a securing screw 57.

The holes 10*a* in the perforated sleeve 10 can, on one or both side halves of the rotor 8, slope in and/or against the direction of rotation. By this means, the stream of liquid and/or the stream of powder is assisted, forced or slowed down during rotation.

The rotor rim 68 is formed by one or preferably a number of peripherally distributed rotor blades 89 in the form of flat webs disposed each in the plane of the rotor 8 and with circumferentially spaced and radially extending openings 90 in between the blades 89. Each blade 89 has two parts; outer and inner rotor rim blades 89*a* and 89*b*, respectively. When a perforated ring 10 is present, one or preferably a number of the outer rotor-rim blades 89*a* are provided outwardly thereof that are secured to the inner surface 86. At least one and preferably a number of the peripherally distributed inner rotor rim blades 89*b* are provided on the outer peripheral edge of the rotor disc 67 and inwardly of the outer rotor rim blades 89*a*. A radial distance "c" between the blades 89*a*, 89*b*, provides clearance therebetween for motion of the rotor 8. The distance "c" is greater than the thickness of tile perforated sleeve 10, so that the stationary perforated sleeve 10 in co-operation with the outer and inner blades 89*a*, 89*b* form an inner and an outer shearing rim, respectively, and consequently form a dispersing device 91.

In the present embodiment, the inner blades 89*b* extend on only one side from the rotor disc 67, i.e. downwards in the present case directed towards the first medium-supplying duct 75. The at least one inner rotor-rim blade 89*b* can extend upward to the other side surface of the rotor disc 67, if the rotor disc 67 is at a suitable distance from the perforated sleeve 10 to permit insertion of an upwardly extending inner blade (not shown). The lower ends of the outer and inner blades 89*a*, 89*b* are connected by a rotorring disc 92 rotatably disposed in the spacing "b" between the perforated sleeve 10 and the wall surface 85 with clearance of motion. The disc 92 is axially offset relative to the rotor disc 67 and axially spaced therefrom. The axial and radial dimensions of the rotor rim 68 are preferably such that the rotor rim 68 is adapted to fit in the mixing chamber 7 with a radial clearance from the sleeve 10.

The outer rim blade 89*a* extends up to the stator 10 and extends from near the flat wall surface 84 to the rotor ring disc 92, giving the outer blade 89*a* a greater axial dimension than the inner blade 89*b* which does not extend to the flat wall surface 84. The inner blade 89*b* extends radially outwardly from the rotor disc 67 to the stator 10. The outer and inner blades 89*a*, 89*b* are spaced from the stator 10 to permit their rotation. The peripheral edge of rotor disc 67 does not extend to the stator 10 but rather there is a space between the peripheral edge of the rotor disc 67 and the stator 10, the space providing a radial distance between the peripheral edge of the rotor disc 67 and the stator 10. The inner blade 89*a* is closer to the stator 10 than the outer peripheral edge of the rotor disc 67.

Preferably a thin cylindrical upwardly-projecting ring continuation 93 can be disposed on the lower inner edge of the mixing chamber 7. The ring continuation 93 overlaps the rotor-ring disc 92 on the inside with clearance of motion and extends toward the rotor disc 67 to an end axially spaced from the rotor disc 67. The rotor disc 67 and ring continuation 93 are spaced a distance corresponding to the axial dimension of the portion of the perforated sleeve 10 extending beneath the rotor disc 67 as oriented in FIG. 4 (to the left of the rotor disc 67 as oriented in FIGS. 5–6).

A product outlet adjoins the mixing chamber 7 and is formed by a connecting piece 94 that preferably extends tangentially/perpendicularly from the intermediate casing 1. The connecting piece 94 has a free end that bears a coupling part, preferably a flange coupling 95, for an outlet extension line 96.

For operation of the entire device 60 in general and the dispersion, emulsification and/or suspension unit 61*a* in particular, it is connected with its connecting piece 72 to the associated supply pipe 74 which in turn is connected to a supply of medium, more particularly a liquid. If the second medium, more particularly powder, is not taken from the supply funnel 77, the free end of the tube 79*a* which is mounted in this case is inserted and held in a powder supply.

Operation is initiated by switching on the motor 42, which rotates the rotor 8, preferably at high speed, preferably about 3000 rpm. As a result of the rotation of the rotor 8, on both sides thereof the media are subjected to radial acceleration, which is caused by the at least one inner rotor-rim blade 89*b* and also the outer rotor-rim blade 89*a*. By this means, both media are drawn into the dispersing region, simultaneously dispersed, wetted and finely divided, radially accelerated and ejected. The dispersed product is thus expelled from the product outlet through the connecting piece 94 by the rotation of the rotor 8.

The rotation of the rotor 8 results in a vacuum at both sides of the rotor disc 67 at the center of rotary motion. This results in additionally sucking or drawing in of the media in each respective inlet 79, 74.

Owing to the vacuum, the lower region of the shaft 2 must be sealed. This purpose can be served by a sealing device (general reference 95*a*), which co-operates in known manner with a liquid barrier medium.

Figures 5, 6:
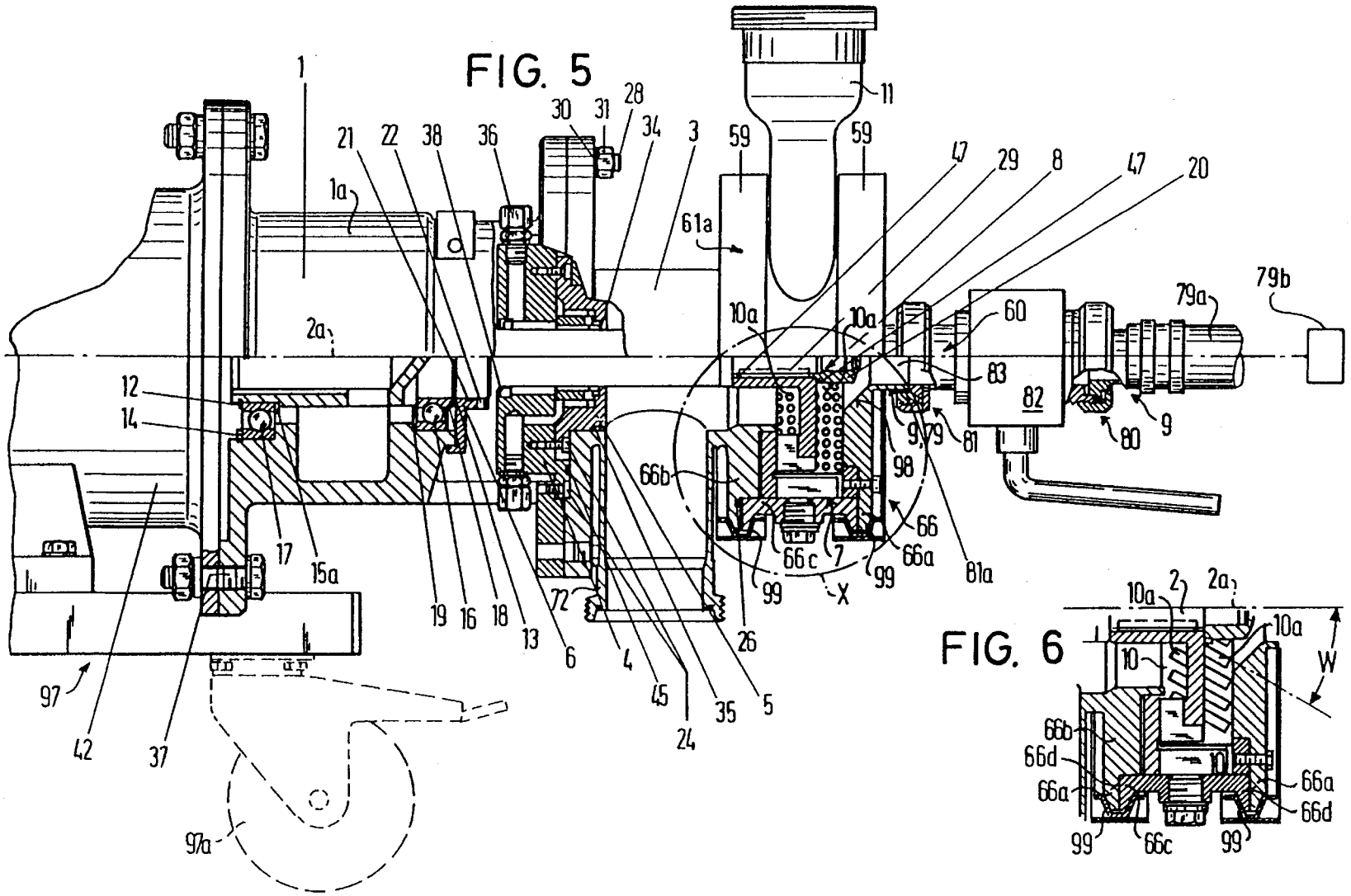
FIG. 5 shows a modified embodiment of the device, when horizontal.
FIG. 6 shows a modification of the detail marked X in FIG. 5.

FIG. 5 shows a embodiment which is similar in operation to the above-described embodiment.

Instead of the arrangement in FIG. 1, in which the stand 61 has insertion openings 61*b* for the forks of a fork-lift truck (not shown) and can therefore easily be loaded and transported, the device 60 in the embodiment in FIG. 5 has a carriage 97 with three or four wheels 97*a*, on which the unit 1*a* is disposed horizontally. Preferably the connecting piece 72 is directed downwards whereas the product outlet 11 is directed upwards. Preferably the unit 1*a*is disposed on the carriage 97 so that the rotor casing 66 projects sideways from the carriage 97 and the associated medium inlet 72, 79 or product outlet 11 is freely accessible.

Preferably the second supply duct 83 widens, more particularly along an internal conical surface 98, into the associated wall surface 84 of the mixing or dispersing chamber 7, thus drawing in the substance more efficiently, more particularly in the case of powder.

In the embodiment in FIG. 6, in which like or comparable parts are denoted by like reference signs, the holes 10*a* in the perforated screen 10 are in the form of sloping slots, which preferably include an angle W of about 30° (angle of slope) with the associated axial plane. This results in a calmer or more uniform flow of material cut up in the shearing gap, and also, depending on the sloping position, the stream of powder or the stream of liquid is assisted or forced during rotation. In the present embodiment, the leading end of the sloping slots are on the powder side, relative to the direction of rotation of the rotor 8, and the trail ends are on the liquid side, thus forcing the stream of powder.

The mixing chamber 7 is bounded axially by two flange members 66*a*, 66*b* and radially by a preferably U-section annular member 66*c*. In their axial edge regions, the flange and annular members 66*a* to 66*c* have outer roof-shaped clamping surfaces on which in each case a V or trapezoidal cross-section clamping ring 99 rests and is clamped in the region of a joint, thus axially holding together the flange and annular members 66*a* to 66*c*. The annular member 66*c* rests in and is centered in internal annular recesses 66*d* in the flanged members 66*a*, 66*b*.

List of parts

| Item | No. | Name |
|---|---|---|
| 1 | 1 | Bearing flange |
| 2 | 1 | Shaft |

-continued

List of parts

| Item | No. | Name |
|---|---|---|
| 3 | 1 | intermediate flange |
| 4 | 1 | Seal casing |
| 5 | 1 | Seal holder |
| 6 | 1 | Centrifugal disc |
| 7 | 1 | Mixing chamber |
| 8 | 1 | Rotor |
| 9 | 1 | Powder inlet |
| 10 | 1 | Screen insert |
| 11 | 1 | Outlet |
| #12 | 1 | Securing ring |
| #13 | 1 | Securing ring |
| #14 | 1 | Securing ring |
| #15a | 5 | Shim |
| #16 | 1 | Ball bearing |
| #17 | 1 | Ball bearing |
| #18 | 1 | Seeger supporting ring |
| #18a | 5 | Shim |
| #19 | 1 | Compensating washer |
| 20 | 1 | Cap nut |
| *21 | 1 | O-ring |
| 22 | 1 | Threaded pin |
| 23 | 1 | Adjusting spring |
| 24 | 4 | Screw |
| 25 | 4 | Screw |
| 26 | 2 | O-ring |
| 28 | 4 | Screw |
| 29 | 4 | Screw |
| 30 | 8 | Spring washer |
| 31 | 8 | Nut |
| 32 | 4 | Washer |
| *33 | 1 | Shaft packing |
| *34 | 1 | P/S lip |
| *35 | 1 | Elastomer |
| 36 | 2 | Straight screwing-in |
| 37 | 4 | Screw |
| 38 | 4 | Spring washer |
| 39 | 1 | Flat gasket |
| 42 | 1 | Three-phase current motor |
| *45 | 1 | O-ring |
| *47 | 2 | Flat gasket |
| *56 | 4 | Sealing ring |
| 57 | 4 | Screw |
| 58 | 1 | Cylinder pin |
| 59 | 2 | Clamping ring |

The following parts are exposed to wear:
*Set of seals 21, 33, 34, 35, 45, 47, 56
#Set of bearings 12, 13, 14, 15a, 16, 17, 18, 18a, 19

I claim:

1. A device suitable for combining substances that are alike or different to obtain a mixed product, the device comprising a rotor casing having an inner surface, a rotor hub rotatable within the rotor casing, the rotor hub having opposed surfaces and a peripheral outer edge, a mixing chamber partially defined by the inner surface and the rotor hub peripheral outer edge, at least one outer rotor blade extending from the inner surface and into the mixing chamber, at least one inner rotor blade extending from the rotor hub peripheral outer edge and into the mixing chamber, a stator positioned between the outer and inner rotor blades, and first and second substance supply ducts adjacent the opposed surfaces of the rotor hub.

2. The device of claim 1 wherein the first and second substance supply ducts provide the substances for mixing adjacent to the rotor hub peripheral outer edge.

3. The device of claim 1 wherein the stator is a perforated stator having openings.

4. The device of claim 3 wherein the rotor hub is rotatable in a direction and the openings in the perforated stator are slots sloped in the direction of rotation of the rotor hub.

5. The device of claim 3 wherein the rotor hub is rotatable in a direction about an axis of rotation, and the openings in the perforated stator are slots sloped in the direction of rotation of the rotor hub at an angle of about 30° with an axial plane.

6. The device of claim 3 wherein the first and second supply ducts are a powder or granule supply duct and a liquid supply duct, respectively, and the openings in the perforated stator are sloped slots whose leading edge is adjacent the powder or granule supply duct and whose trailing edge is adjacent the liquid supply duct.

7. The device of claim 3 wherein the rotor hub is rotatable in a direction and the openings in the perforated stator are slots sloped against the direction of rotation of the rotor hub.

8. The device of claim 3 wherein the rotor hub is rotatable in a direction about an axis of rotation, and the openings in the perforated stator are slots sloped against the direction of rotation of the rotor hub at an angle of about 30° with an axial plane.

9. The device of claim 1 wherein the rotor hub is rotatable about an axis, the first and second supply ducts are a powder or granule supply duct and liquid supply duct, respectively, and the inner rotor blade extends axially from the rotor hub only towards the liquid supply duct.

10. The device of claim 1 wherein the stator is a perforated stator that extends beyond the opposed surfaces of the rotor hub.

11. The device of claim 1 further comprising a product outlet in communication with the mixing chamber.

12. The device of claim 1 wherein the first supply duct has a width that widens adjacent to the rotor hub.

13. The device of claim 12 wherein the first supply duct is a powder or granule supply duct.

14. The device of claim 1 wherein the rotor hub is rotatable about an axis and the outer rotor blade has a greater axial dimension than the inner rotor blade.

15. The device of claim 1 wherein the rotor hub peripheral outer edge is spaced from the stator and the inner rotor blade is closer to the stator than the rotor hub peripheral outer edge.

16. A device suitable for combining substances that are alike or different to obtain a mixed product, the device comprising a rotor casing having an inner surface, a rotor hub rotatable about an axis within the rotor casing, the rotor hub having opposed surfaces and a peripheral outer edge, a mixing chamber partially defined by the inner surface and the rotor hub peripheral outer edge, at least one outer rotor blade extending from the inner surface and into the mixing chamber, at least one inner rotor blade extending from the rotor hub peripheral rotor outer edge and into the mixing chamber, a perforated stator positioned between the outer and inner rotor blades and having openings therein, and first and second substance supply ducts adjacent the opposed surfaces of the rotor hub, the outer rotor blade having a greater axial dimension than the inner rotor blade, the rotor hub peripheral outer edge being spaced from the stator and the inner rotor blade being closer to the stator than the rotor hub peripheral outer edge.

17. The device of claim 16 wherein the openings in the perforated stator are slots sloped in the direction of rotation of the rotor hub.

18. The device of claim 16 wherein the rotor hub is rotatable in a direction about an axis of rotation, and the openings in the perforated stator are slots sloped in the direction of rotation of the rotor hub at an angle of about 30° with an axial plane.

19. The device of claim 16 wherein the first and second supply ducts are a powder or granule supply duct and a liquid supply duct, respectively, and the openings in the perforated stator are sloped slots whose leading edge is adjacent the powder or granule supply duct and whose trailing edge is adjacent the liquid supply duct.

20. The device of claim 16 wherein the rotor hub is rotatable in a direction and the openings in the perforated stator are slots sloped against the direction of rotation of the rotor hub.

21. The device of claim 16 wherein the rotor hub is rotatable in a direction about an axis of rotation, and the openings in the perforated stator are slots sloped against the direction of rotation of the rotor hub at an angle of about 30° with an axial plane.

* * * * *